United States Patent [19]

van den Beld

[11] 4,004,481

[45] Jan. 25, 1977

[54] DEVICE FOR MAKING A PERFORATION IN FILM MATERIAL

[75] Inventor: Paul Christian Herman van den Beld, Hardenberg, Netherlands

[73] Assignee: Wavin B.V., Zwolle, Netherlands

[22] Filed: June 24, 1975

[21] Appl. No.: 589,684

[30] Foreign Application Priority Data

June 26, 1974 Netherlands ..... 7408625

[52] U.S. Cl. ..... 83/555; 83/620; 83/695

[51] Int. Cl.[2] ..... B26D 5/08

[58] Field of Search ..... 83/54, 620, 622, 554, 83/555, 695, 100

[56] References Cited

UNITED STATES PATENTS

| | | | |
|---|---|---|---|
| 524,691 | 8/1894 | McLane | 83/622 |
| 3,456,540 | 7/1969 | Manini | 83/695 X |
| 3,593,611 | 7/1971 | Sagehorn | 83/620 X |
| 3,735,654 | 5/1973 | Jurasek | 83/100 |
| 3,795,163 | 3/1974 | Armstrong et al. | 83/555 X |

*Primary Examiner*—Leon Gilden
*Attorney, Agent, or Firm*—Wigman & Cohen

[57] ABSTRACT

Device for making a perforation in film material, especially plastics film material, said device comprising a reciprocatable support beam for a plurality of perforating blades the cutting edges of which are saw-tooth shaped. A driving means moves, simultaneously with the support beam a series of suction members in the direction of the operative position and back, said series extending with minor spacing substantially parallel to the perforating blades. Means are provided for the support beam and the series of suction members to perform, during displacement between the operative position and the rest position, but at a distance from the operative position, a relative displacement in the longitudinal direction, such that the top film layer is cut through while the other layer remains just perforated.

6 Claims, 5 Drawing Figures

DEVICE FOR MAKING A PERFORATION IN FILM MATERIAL

BACKGROUND OF THE INVENTION

My invention relates to a device for making a perforation in film material, especially plastics film material, said device comprising a support for a plurality of perforating blades which is movable up and down.

In manufacturing products in plastics film material such as bags which are often produced in tube shaped film, with continuous manufacture in a production line having various operating stations, it is usual to make a perforation in the transverse direction which assures that the various unit lengths keep interconnected when passing along the line but are capable of being separated very easily when they are finished. When several layers of film lying upon each other are concerned, as is naturally the case when film tube is employed, this perforation is made in all layers. In similar cases it might be desirable, however, when one of the layers would be cut entirely, whilst the perforation, and thus the interconnection of the various units, exists only in one single layer. In this way tearing off the units would be easier because the force required for this purpose would reduced by half. This is of special importance when working up relatively thick film material, for example on the order of magnitude of 300 micron, which is used, for example, for heavy bags for industrial applications.

THE OBJECTS OF THE INVENTION

The primary object of the invention is to provide a device by which, when working up several layers of film material, it will be ensured that at least part of the top layer is cut entirely whilst the lower layers are just perforated.

Another object is to provide a device of the type mentioned, in which the length of the slits constituting the perforations can be adjusted and in which also the length of the cut in the top layer can be adjusted as desired.

Still another object is to provide such apparatus which is automatically operated.

Other objects will appear from the detailed description of an embodiment which is given below.

SUMMARY OF THE INVENTION

In the device according to the invention, which comprises a support for a plurality of perforating blades, said support being movable up and down in the manner of a common stamping beam, the cutting edges of the perforating blades are saw-tooth shaped, and the driving means moves, simultaneously with the support for the blades, a series of suction members in the direction of the operative position and back, said series extending with minor spacing substantially parallel to the perforating blades, and further means are provided for the support and the series of suction members to perform, during displacement between the operative position and the rest position, but spaced from the operative position, a relative displacement in the longitudinal direction.

With a stamper realized in this way the down-going stroke makes a perforation in all layers of the film lying one upon the other. In the upward stroke it is possible to supply vacuum to the suction apertures, whereby the top layer of film is lifted so that the tips of the blades do not leave the slits in the material. Thereupon, the relative lengthwise displacement will occur between the blade support and the suction members which hold the film material. This relative displacement causes the blades to cut through the bridges of material between the previously made slits in the top layer. After that the vacuum can be disconnected again so that the top film layer will be released.

Preferably, the series of suction members is constituted by a series of apertures in a wall of a tube shaped section the ends of which are closed and which is connected to a suction source.

The structure and the driving means of the whole device are simplified to a great extent in a preferred embodiment in which the blade support is affixed to the closed section having the suction apertures by means of a pin and hole connection, the driving means imparting to said closed section a vertical reciprocating movement, and the blade support being spring biased against a fixed point of the device by means of a cam and a tension roller. Thus it is sufficient to impart to the closed section only a reciprocating movement in the vertical direction which causes the horizontal displacement of the blades, for causing the cutting movement in the top film to take place automatically.

The saw-tooth shape of the blades advantageously provides for the opportunity to influence the ratio between the length of the cuts and the length of the bridges of material between the cuts on the line of perforation. Preferably, for this purpose the tips of the blades have an individual adjustability of the thrust depth relative to the lower face of the support or the closed section, respectively. As two adjacent blades thrust to a greater depth a longer cut and a shorter bridge of material are formed, up to the moment at which eventually the bridge of material is cut through entirely. The last mentioned effect may be of interest when film tube is employed having two lateral folds, in view of manufacturing bags the cross sections of which are substantially rectangular. In that case by appropriate adjustment of the height of the blades it may be arranged that over the width of the lateral folds complete cutting of top and lower layer will occur, whilst in the intermediate film portion the bottom layer is given a perforation and the top layer is cut through in full.

The invention will hereinafter be clarified with reference to the accompanying drawing which shows an embodiment by way of example.

BRIEF DESCRIPTION OF THE FIGURES

FIG. 4*a* in the end position of the stamping beam and FIG. 4*b* half way in the upward stroke.

DETAILED DESCRIPTION OF A PREFERRED EMBODIMENT

Figures 1, 2, 3:
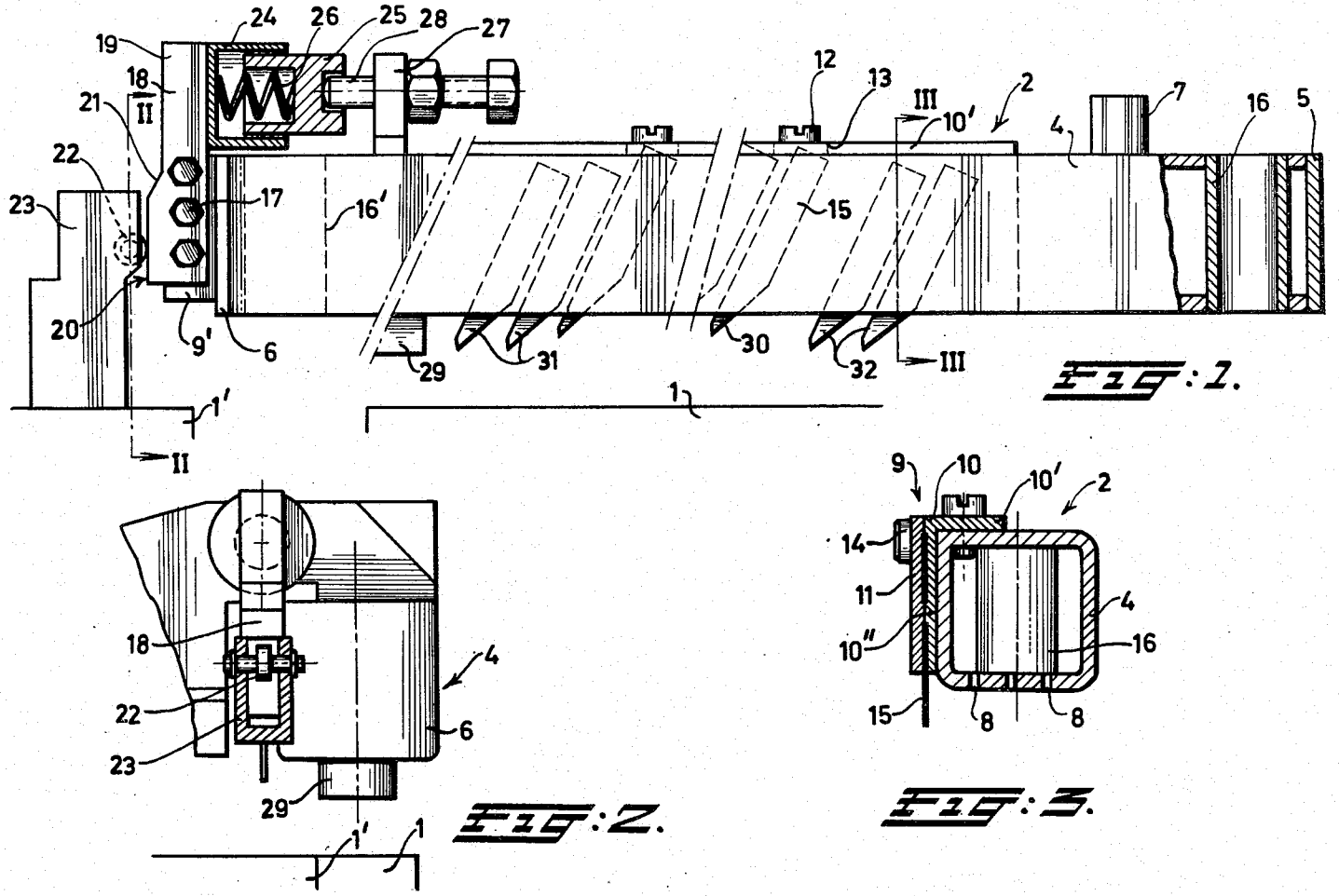
FIG. 1 is an elevation of the device.
FIG. 2 is a side-view of the stamping beam as seen according to the arrows II—II in FIG. 1.
FIG. 3 is a cross-sectional view of the stamping beam according to the arrows III—III in FIG. 1.

The device for making a perforation comprises a table 1 and a stamping beam 2 movable up and down with respect to the table.

The stamping beam comprises a closed section or stamping beam 4, in this instance having a square cross sectional profile, vacuum closed at the ends 5, 6. At the top there is provided a vacuum connection 7 by which the interior space of the section can be connected to a source of vacuum (not shown). In the lower face over the entire length of the section three series of suction apertures 8 (see FIG. 3) are provided.

Also the stamping beam 4 comprises a blade support 9. In the elevational view of FIG. 1 the latter is situated at the rear of section 4. The blade support 9 is composed of a pair of strips, viz. an angled strip 10 and a flat strip 11. The angled strip serves to affix the blade support in its entirety with respect to the square section 4 in the way that one leg 10' of the strip lies on top of the square section and the other leg 10'' against the lateral face. The angled strip 10 is movable over a small distance lengthwise with respect to the beam 4 in the way that a plurality of fastening screws such as 12 are passed through the slit shaped holes such as 13 in strip member 10' so as to be screwed into threaded holes in the top face of section 4.

The flat strip 11 may be fastened by means of a number of short bolts such as 14 against the angled strip 10, viz. adjacent the leg 10'' thereof, in order to clampingly fasten a series of blades such as 15 to the beam. These blades may be thin steel blades and if desired they may additionally be arranged in a plurality of grooves of minor depth which are machined in either one of the two strip members 10'' or 11, or in both of them if desired as is visible in FIG. 3. Preferably, the arrangement is such that the blades are adjustable in height. Details of this adjustability have not been shown as this will not constitute any problem to the man skilled in this art. The oblique condition of the blades such as 15 which is visible in FIG. 1 is not necessarily so. The oblique condition has been represented here because thereby one may obtain an advantageous course of the cutting edges, as will be treated in more detail, by employing commercially available blades, such as manufactured by Stanley, in this condition in the stamping beam.

The stamping beam in its entirety is vertically reciprocatable by means of a drive not represented because it can be implemented very easily by the man skilled in this art, or copied from the prior art perforating beams. For example, the stamping beam at either one of its ends is provided with a cylinder 16, 16' through which rods may be passed for transmitting the stroke from the driving means to the stamping beam.

As seen in FIG. 1 the blade support, in form of the pair of clamping strips 10, 11, at the left hand extremity projects over a small distance with respect to the end face 6 of the profile section. At this projecting extremity 9' of the blade holder 9 a cam support 18 is affixed by means of several bolts such as 17. The surface opposite the stamping beam is provided with two flat cam faces 19, 20, interconnected by a sloping cam face 21. These cam faces 19, 21, 20 constitute a cam track through the medium of which cam support 18 abuts against a cam follower or roller 22 fixedly arranged in a fork 23 which in turn is stationary with respect to the machine frame or table 1.

As shown, the cam support 18 projects upwardly with respect to the beam 4. This projecting portion is provided with a bushing 24 in which a sleeve 25 is slidable, in between them a compression spring 26 being provided. The sleeve 25 is supported by a flange 27 on top of the section 4 by means of a set screw 28. The compression spring 26 thus assures that the blade holder 9 in its entirety is continuously urged to the left with respect to the section 4 of the stamping beam, with the effect that the cam roller 22 and the cam face 20, 21, 19 are in permanent contact. The portion 20 of the cam face is higher than cam face portion 19, so that the blade holder 9 when the stamping beam moves downwardly makes a small displacement to the left as seen in FIG. 1.

At the bottom of section 4 there is also a stop member 29 which defines the extreme position of the stamping beam which is the operative position, in that it abuts against the surface of table 1.

In a manner known per se the cutting edges such as 30 of the blades in the whole series show a saw-tooth pattern. Adjustment of the thrust depth of the blades with respect to the bottom surface of the support or section 4 determines whether a perforation is made consisting of short cuts and relatively wide bridges in between, or whether by greater depth the cut will become longer accompanied by correspondingly lesser width of the intermediate material which keeps the areas on either side of the line of perforation together. In the extreme situation, when the thrust depth is sufficient, one obtains no perforation anymore but a complete cut. For this purpose it is advantageous to arrange the blade close to one another, such that the vertical imaginary line through the highest point of the oblique cutting edge of any blade does not coincide precisely with the lowermost point of the adjacent blade but a little beyond that. In this way it is fully assured that a complete cut will be obtained, even when for example the blade tip would be somewhat worn.

Figure 4A:
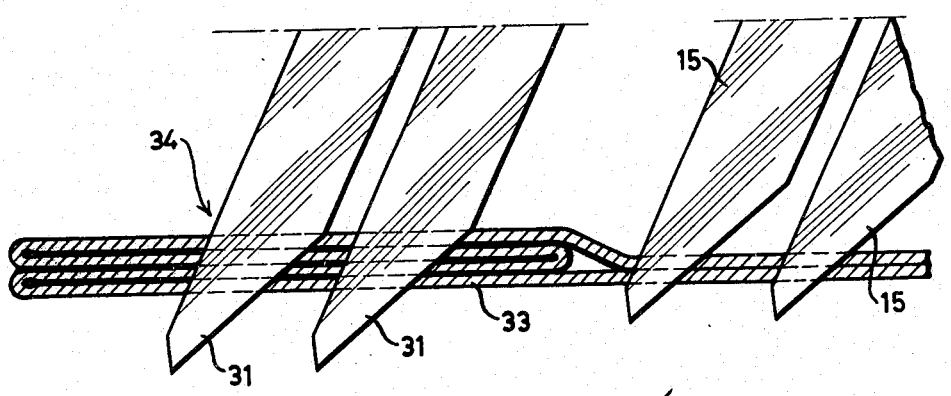
FIGS. 4*a* and 4*b* show diagrammatically and in enlarged scale, in form of vertical sectional views, the effect of the blades on a tube shaped film having a lateral fold, viz.

In FIG. 1 it can be seen that at the extreme left hand end and at the extreme right hand end of the series some blades such as 31 and 32 have been adjusted to greater thrust depth, the blades of the series in between having less thrust depth. It will be understood that this is only one feasible embodiment, which was chosen here in view of working on film tube which is supplied having lateral fold, and in view of the desirability to completely cut all layers of material at the location of these lateral folds. This is again represented in FIGS. **4*a* and 4*b*, in a very diagrammatical manner and with exaggerated dimensions of the film layers which are as a matter of course usually extremely thin. FIG. 4*a* represents the end of the perforating stroke. The two blades 31 have been adjusted such that the lowermost film layer 33 at the location of the lateral fold 34 is cut at the moment to a great extent already. Other blades such as 15 are higher. In FIG. 4*a* it can be seen that at the end of the stroke they have only perforated the bottom layer 33** to a small extent.

FIG. **4*b* shows the position of a beam at the end of the horizontal component of motion which is implemented during the upward stroke. The blade have now risen and gone to the right, in accordance with the course of the cam track 19, 21, 20 (FIG. 1). When the blades are adjusted for great depth, such as blades 31, the horizontal component of motion which is performed with these deep blades still having a considerable tip portion of the cutting edge through the lowermost film layer 33,** will cause the material of the initially present bridges to be cut through completely.

Blades of lesser depth such as 15 have not yet left the lowermost film layer even in the condition represented in FIG. **4*b*, but their cutting edges will, under the influence of the horizontal component of movement, only go where they themselves already made a cut. So there the cuts 35** will remain of the same length.

Figure 4B:
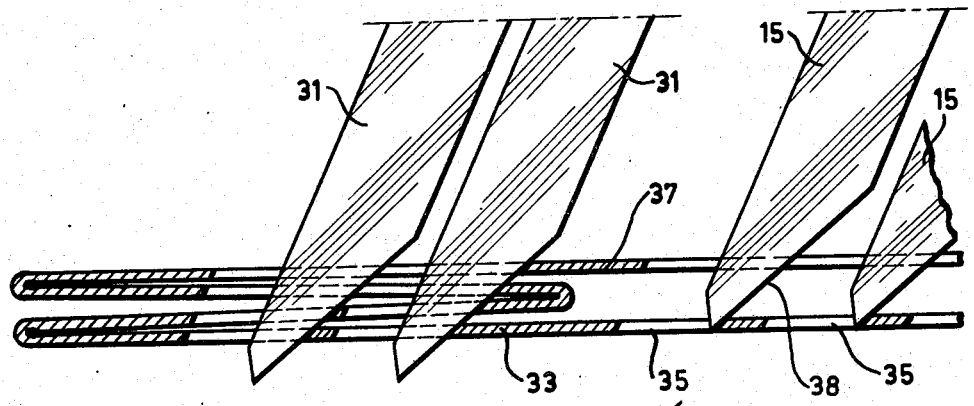

Also in FIG. 4*b* it can be seen that, when the stamping beam goes up, the lowermost layer 37 stays behind whilst the top film layer 33 has been lifted by the suction. As a consequence the cutting edges of the blades 15 have entirely cut all material bridges in the top layer under influence of the horizontal component of motion. The final result is a web of film tube in which all layers at the location of the lateral folds have been cut through in full, the intermediate main area being perforated in the bottom layer and the top layer thereof being cut through entirely.

I claim:

1. Apparatus for perforating film material such as plastic film material comprising a beam, a plurality of perforating blades having a saw-tooth shape supported on said beam, table means arranged in confronting relation to said blades for supporting the material to be perforated, means for vertically reciprocating said beam between a first operative position adjacent said table means and a second operative position spaced from said table means, suction means associated with said beam and vertically movable therewith for releasably holding at least a top layer of the material to be perforated in engagement with said blades during reciprocation of said beam from said first to said second operative position, and means for longitudinally moving said blades relatively of said suction means and the material to be perforated during reciprocation of said beam from said first to said second operative position.

2. Apparatus according to claim 1 wherein the longitudinal movement of said blades is sufficient to cut through in full said top layer of the material to be perforated.

3. Apparatus according to claim 1 wherein said beam includes a tube having closed ends, and wherein said suction means comprises a plurality of suction apertures in the wall of said tube, said apertures having a minor space therebetween and means for connecting said tube to a vacuum source.

4. Apparatus according to claim 1 wherein said means for longitudinally moving said blades includes a cam and a cam follower, one of said cam and cam follower being fixed relative to said table means, the other of said cam and cam follower being movable with said blades and spring means for resiliently biasing said cam against said cam follower.

5. Apparatus according to claim 1 wherein said plurality of blades are longitudinally aligned in series, each of said blades being individually vertically adjustable relative to the other blades.

6. Apparatus according to claim 5 wherein said film material is a flattened tube having top and bottom layers and double folds at the lateral sides thereof and wherein each of said blades has an adjusted thrust depth, a number of said blades arranged at the extremities of said series of blades being adjusted to a greater thrust depth than the blades intermediate thereof such that when said beam is reciprocated to said first operative position, the film layers of said double folds are cut through in full and the top and bottom layers of said flattened tube intermediate said folds are perforated and when said beam is reciprocated to said second operative position and said blades are longitudinally moved relative to said suction means, the top layer of said flattened tube intermediate said folds is cut through in full.

* * * * *